US006572495B1

(12) United States Patent
Ferrari

(10) Patent No.: US 6,572,495 B1
(45) Date of Patent: Jun. 3, 2003

(54) MULTI-PURPOSE GOLFER'S TOOL

(76) Inventor: R. Keith Ferrari, 4669 Bethesda Rd., Thompson Station, TN (US) 37179

( * ) Notice: Subject to any disclaimer, the term of this patent is extended or adjusted under 35 U.S.C. 154(b) by 12 days.

(21) Appl. No.: 09/997,791

(22) Filed: Nov. 30, 2001

(51) Int. Cl.[7] ..... A63B 57/00
(52) U.S. Cl. ..... 473/408; 131/248
(58) Field of Search ..... 473/408, 406, 473/407, 285, 286, 284, 387; D21/793; 131/248, 250, 187

(56) References Cited

U.S. PATENT DOCUMENTS 5,643,114 A 7/1997 Marcus
5,706,831 A 1/1998 Whitbeck
5,743,276 A 4/1998 Tamayo-Rivera et al.
5,759,120 A 6/1998 Mathis et al.
5,788,197 A 8/1998 Tutela
5,813,414 A 9/1998 Zutler et al.
5,816,262 A 10/1998 Javnozon
5,819,750 A 10/1998 Moyer
6,022,280 A 2/2000 Arenburg et al.
6,162,137 A 12/2000 Jones et al.

*Primary Examiner*—Steven Wong
(74) *Attorney, Agent, or Firm*—Cook, Alex, McFarron, Manzo, Cummings & Mehler, Ltd.

(57) ABSTRACT

A multi-purpose golfer's tool including a retractable ball-mark repair blade and a cigar cutter, the housing for the tool having a central opening adapted to receive the end of a cigar. The ball-mark repair blade is actuated by a lever arm that is secured to the blade by means of, e.g., a hinge. The lever arm is adapted to present a smooth flush surface with the housing when the blade is retracted. The lever arm may also include a magnet so as to removably secure a magnetic/magnetizable ball marker to the tool.

8 Claims, 2 Drawing Sheets

MULTI-PURPOSE GOLFER'S TOOL

BACKGROUND OF THE INVENTION

The present invention relates to a multi-purpose golfer's tool.

With the increasing popularity of golf as a sport and leisure activity, there has been a proliferation of accessories intended to make the golfer's round both more enjoyable and more consistent with good golfing practices. A number of multi-purpose golfing accessories have been designed to provide, in various combinations, a ball-mark or divot repair tool, a ball-marker, a club holder, a cigar holder and a cigar cutter. See, for example, U.S. Pat. Nos. 5,643,114, 5,760,831, 5,743,276, 5,759,120, 5,788,197, 5,813,414, 5,816,262, 5,819,750, 6,022,280, and 6,162,137.

While each of the tools described in these patents are capable of performing their various intended functions, there is need for providing a more compact multi-purpose golfer's tool that is as stylish in its appearance as it is functional in its use.

Accordingly, it is a principal object of the present invention to provide a multi-purpose golfer's tool.

More particularly, it is the object of the present invention to provide a multi-purpose golfer's tool that includes tools for the repair of ball-marks or divots, and for cutting off the ends of cigars, as well as be adapted to hold a cigar and ball-marker.

It is a more particular object to provide such a multi-purpose golfer's tool that is compact, highly functional and stylish.

These objects, as well as others that will become apparent upon reference to the following detailed description and accompanying drawings are provided by a multi-purpose golfer's tool comprising a generally planar ball-mark repair blade that includes a central opening sized to receive the end of a cigar and a hinge. A lever arm is provided that has first and second ends, with the first end being pivotally attached to the ball-mark repair blade at the hinge so that the lever arm may move between a first position generally overlying the blade and a second position in general axial alignment with the ball-mark blade. The lever arm may include a protruding boss on one side that is spaced from the first end, the boss being sized to protrude through the central opening of the ball-mark repair blade when the lever is in its first position. A casing or housing is provided that defines a track for receiving the ball-mark repair blade and for permitting sliding motion of the blade with respect thereto. Thus, the ball-mark repair blade may be selectively extended from the housing or retracted into the housing when the lever arm is in the second position. The casing or housing also includes a central opening, also sized to receive the end of a cigar and for receiving the protruding boss of the lever arm. A cutting blade that includes a cutting edge is integral with the ball-mark repair blade, the cutting edge extending obliquely with respect to the central opening in the ball-mark repair blade so that, as the ball-mark repair tool moves from its retracted position to its extended position, the cutting edge moves across the central opening in the casing. The tool may also optionally include a magnetic member formed integrally with the lever arm, the magnetic member being adapted to secure a magnetizable ball-marker or cigar holder.

DETAILED DESCRIPTION

Figures 1, 2:
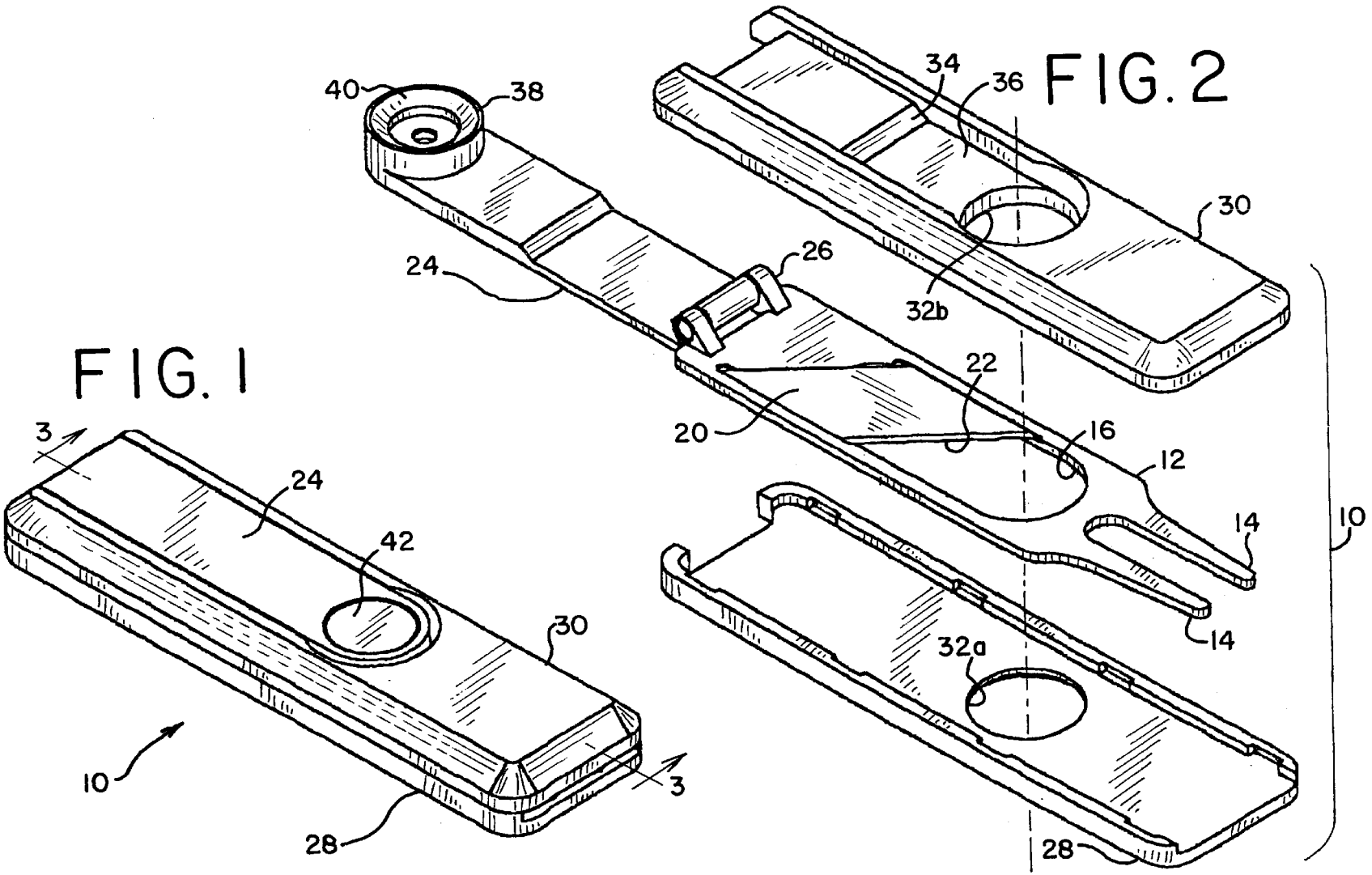
FIG. 1 is a perspective view of the multi-purpose golfer's tool according to the present invention
FIG. 2 is an exploded perspective view of a multi-purpose golfer's tool of FIG. 1

Turning to the figures of the drawing, there is seen in FIG. 1 a perspective view of a multi-purpose golfer's tool, generally designated 10, according to the present invention. The tool 10 is shown in its compact, folded condition, in which the tool 10 has a generally flat configuration and is sized to easily fit within the golfer's pocket.

With reference to the exploded view of FIG. 2, the various component parts of the tool 10 are more clearly seen. The working portion of the tool 10 includes a generally flat or planar ball-mark repair blade 12, preferably made of a durable, corrosion resistant material such as stainless steel. As illustrated, the blade 12 includes a pair of tines 14 that are adapted to cut into the turf of a putting green underneath a ball mark in order to pry up the ball-mark and return the putting surface to a level, smooth condition.

Figure 4:
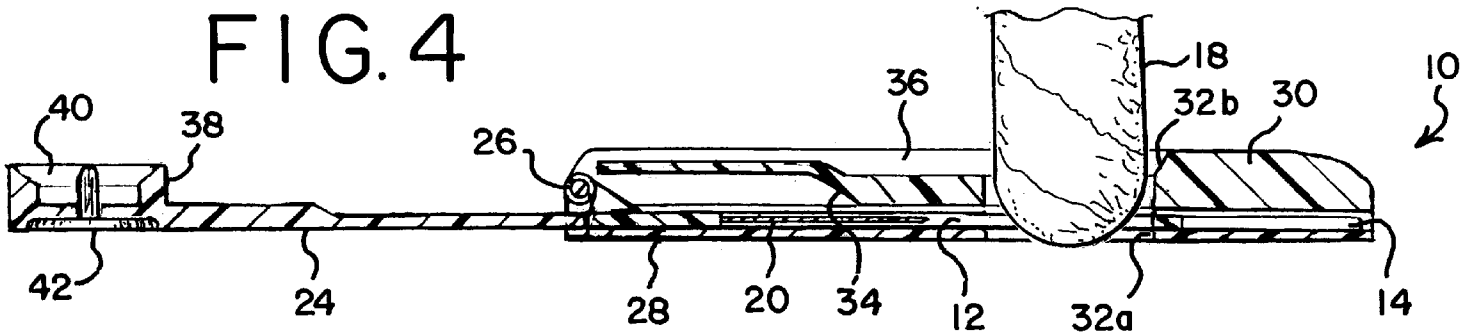
FIGS. 4 and 5 are cross-sectional views of the golfer's tool similar to FIG. 3 showing the tool being used to cut off the end of a cigar.
Figure 5:
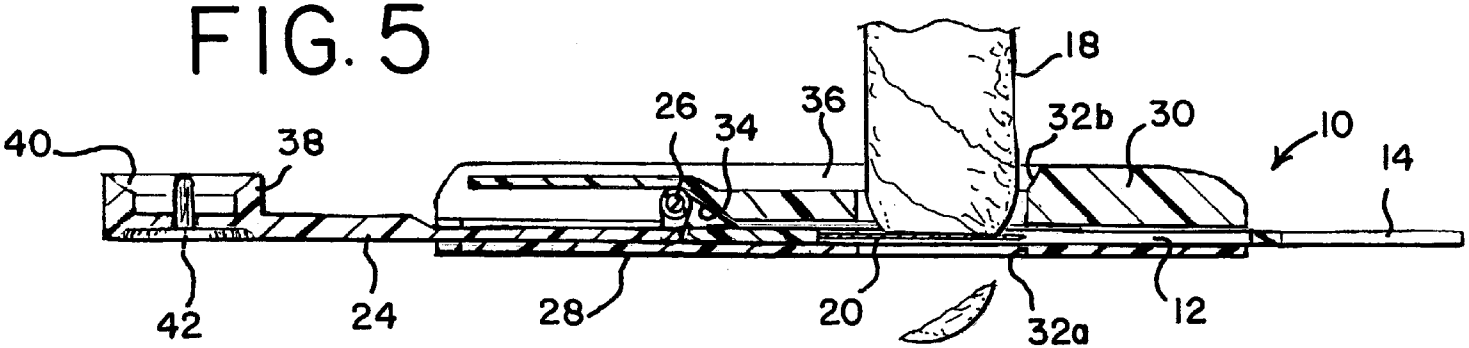

The blade 12 includes an elongated central opening 16 sized to receive the end of a cigar 18 (as seen in FIGS. 4 and 5). A cutting blade 20 is secured to the ball-mark repair blade 12 so that the cutting edge 22 of the blade 20 extends obliquely across the central opening 16 in the blade 12.

Figure 3:
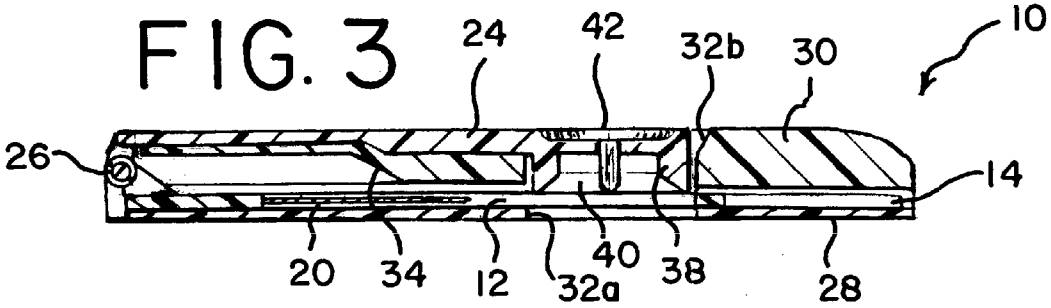
FIG. 3 is a cross-sectional view of the golfer's tool taken along line 3—3 of FIG. 1.

A handle or lever arm 24 is pivotally secured to the end of the ball-mark repair blade opposite the tines 14 by means of a hinge 26. The hinge 26 permits the lever arm 24 to pivot through an arc of approximately 180 degrees between a first position in which the lever arm 24 generally overlies the ball-mark repair blade 12 (as seen in FIGS. 1 and 3) to a second position in which the lever arm 24 and the ball-mark repair blade 12 are generally co-planar or in axial alignment (as seen in FIGS. 2, 4 and 5).

The ball-mark repair blade 12 and its associated cutting blade 20 are slidingly received in a housing comprising two mating halves 28, 30. As illustrated, the two halves 28, 30 snap fit together and permit the blade to be moveable between a retracted position (in which the tines 14 and cutting blade 20 are completely within the housing, as shown in FIGS. 1 and 3) and an extended position (in which the tines are positioned for the repair of a ball-mark, as shown in FIG. 5). To this end, the bottom half 28 of the housing comprises an elongated track along which the ball-mark repair blade 12 is adapted to slide.

In accordance with one aspect of the invention, the two halves 28, 30 of the housing are each formed with a central opening 32*a*, 32*b* that are in alignment with each other and, when the ball-mark repair blade 12 is in its retracted position, also in alignment with the central opening 16 in the blade 12. This permits the end of a cigar 18 to be inserted through the aligned openings 16, 32*a*, 32*b* when the lever arm 24 is pivoted to the position shown in FIG. 4. The ball-mark repair blade 12 can then slide along the track so that the end of the cigar 18 is cut off by the cutting blade 20, thus facilitating in the smoking of the cigar. The same sliding action also exposes the tines 14 of the blade 12 so that ball-marks may be repaired, as described above.

In keeping with another feature of the invention, the housing 28, 30, blade 12, and lever arm 24 are configured to limit the travel of the blade 12 through the housing 28, 30 so that the cutting edge of the cutting blade does not move outside the confines of the housing. To this end, the housing 28, 30 and blade 12 or lever 24 have interfering stops. As illustrated, the housing member 30 is formed with a shoulder 34 which is adapted to be engaged by the hinge 26 connecting the lever arm 24 to the blade 12 (see FIG. 5), thus limiting the movement of the blade 12 with respect to the housing.

In another aspect of the invention, the tool 10 is configured so that when the blade 12 is retracted into the housing 28,30, the lever arm can lie flush with the housing member 30 to present a smooth upper surface, as seen in FIGS. 1 and 3. To this end, the upper surface of the housing 30 is formed with a recess 36 that has a shape complementary to that of the lever arm 24.

In a still further aspect of the invention, the lever arm 24 is formed with a boss 38 sized to be received in the aligned central openings 16, 32*a*, 32*b* of the blade 12 and housing 28, 30 when the lever arm 24 is in the closed position (FIGS. 1 and 3). When received through the openings 16, 32*a*, 32*b*, the boss 38 more positively locates the lever arm in the closed position. The boss 38 also helps to lock the blade 12 in place when the lever arm 24 is closed, thus reducing the likelihood of unintended contact with the cutting blade 20.

As illustrated, the boss 38 may also include a magnetic member 40. The magnetic member 40 can be used to removably secure a magnetic/magnetizable ball marker 42 to the tool 12. The magnetic member 40 may also permit the tool to be used as a cigar holder, when the cigar includes a band that secures a magnetic/magnetizable member thereto, as shown in my co-pending application Ser. No. 09/848,566, filed May 3, 2001, and incorporated by reference herein. When used as a cigar holder in conjunction with the magnetizable cigar band described above, the tines 14 of the blade 12 are inserted into the turf, with the lever arm 24 extending away from the turf and the magnetic member 40 securing the cigar to the tool 10 safely off the ground.

Thus, a multi-purpose golfer's tool has been described that meets all the objects of the present invention. While the invention has been described in terms of a preferred embodiment, there is no intent to limit the invention to the same. Instead, the invention is defined by the following claims.

What is claimed:

1. A multi-purpose golfer's tool comprising:

a) a generally planar ball-mark repair blade including a hinge and first central opening sized to receive the end of a cigar;

b) a lever arm having first and second ends, the first end being pivotally attached to the ball-mark repair blade at the hinge for movement between a first position generally overlying the blade member and a second position in general axial alignment with the ball-mark repair blade, the lever arm having a protruding boss on one side thereof spaced from the first end and sized to protrude through the central opening of the ball-mark repair blade when the lever arm is in the first position;

c) a housing defining a track for receiving the ball-mark repair blade and for permitting sliding motion of the ball-mark repair blade with respect to the housing to selectively extend and retract the ball-mark repair blade therefrom when the lever arm is in the second position, the housing including a second central opening there through sized to receive the end of a cigar and for receiving the protruding boss of the lever arm when the lever arm is in the first position; and d) a cutting blade including a cutting edge integral with the ball-mark repair blade, the cutting edge extending obliquely with respect to the first central opening so that as the ball-mark repair blade moves from its retracted position to its extended position, the cutting edge of the cutting blade moves cross the second central opening in the housing.

2. The multi-purpose golfer's tool of claim 1 further comprising a magnetic member formed integrally with the lever arm, the magnetic member being adapted to secure a magnetizable item thereto.

3. The multi-purpose golfer's tool of claim 2 further comprising a ball-marker adapted to be magnetically secured to the magnetic member of the lever arm when the lever arm is in its first position.

4. A multi-purpose golfer's tool of claim 1 wherein the housing is formed of the first and second mating parts, the first part having an elongated portion forming the track for the ball-mark repair blade, the second part being adapted to be secured to the first part and having a recess that permits the lever arm to be flush with the outer surface of the second part of the housing when the lever arm is in the first position.

5. A multi-purpose golfer's tool of claim 4 wherein the housing and the lever arm have complimentary shapes so that when the lever arm is in the first position, the lever arm is substantially flush with the casing.

6. The multi-purpose golfer's tool of claim 1 wherein the housing and one of the blade or lever have interfering stops to limit the extent of movement of the ball-mark repair blade out of the housing.

7. The multi-purpose golfer's tool of claim 6 wherein the housing has an interior formed with a shoulder that constitutes one of the interfering stop members.

8. The multi-purpose golfer's tool of claim 1 wherein the ball-mark repair blade includes a working end that has two tines adapted to pry up ball-marks from putting greens.

* * * * *